US009695995B2

(12) United States Patent
Grajcar

(10) Patent No.: US 9,695,995 B2
(45) Date of Patent: Jul. 4, 2017

(54) METHOD OF MANUFACTURING A LIGHT EMITTING DIODE LIGHTING ASSEMBLY

(71) Applicant: Once Innovations, Inc., Plymouth, MN (US)

(72) Inventor: Zdenko Grajcar, Orono, MN (US)

(73) Assignee: Once Innovations, Inc., Plymouth, MN (US)

( * ) Notice: Subject to any disclaimer, the term of this patent is extended or adjusted under 35 U.S.C. 154(b) by 0 days.

(21) Appl. No.: 15/017,838

(22) Filed: Feb. 8, 2016

(65) Prior Publication Data

US 2016/0223148 A1 Aug. 4, 2016

Related U.S. Application Data

(63) Continuation of application No. 14/046,184, filed on Oct. 4, 2013, now Pat. No. 9,255,674.

(Continued)

(51) Int. Cl.

| | |
|---|---|
| ***F21V 1/00*** | (2006.01) |
| ***F21K 9/90*** | (2016.01) |
| ***F21V 17/16*** | (2006.01) |
| ***F21V 29/75*** | (2015.01) |
| ***F21V 29/77*** | (2015.01) |
| ***F21K 9/232*** | (2016.01) |
| ***F21K 9/233*** | (2016.01) |

(Continued)

(52) U.S. Cl.

CPC ..... *F21K 9/90* (2013.01); *F21K 9/232* (2016.08); *F21K 9/233* (2016.08); *F21V 3/0472* (2013.01); *F21V 17/164* (2013.01); *F21V 29/70* (2015.01); *F21V 29/75* (2015.01); *F21V 29/773* (2015.01); *F21K 9/60* (2016.08); *F21V 3/02* (2013.01); *F21V 3/0436* (2013.01); *F21V 5/04* (2013.01); *F21V 7/22* (2013.01); *F21Y 2101/02* (2013.01); *F21Y 2115/10* (2016.08); *Y10T 29/49002* (2015.01)

(58) Field of Classification Search

CPC ..... F21K 9/90; F21V 29/70

See application file for complete search history.

(56) References Cited

U.S. PATENT DOCUMENTS

| | | | |
|---|---|---|---|
| 4,939,426 | A | 7/1990 | Menard et al. |
| 5,495,147 | A | 2/1996 | Lanzisera |

(Continued)

FOREIGN PATENT DOCUMENTS

| | | | |
|---|---|---|---|
| CN | 101162847 | A | 4/2008 |
| CN | 102612791 | A | 7/2012 |

(Continued)

OTHER PUBLICATIONS

"U.S. Appl. No. 13/355,182, Non Final Office Action mailed Oct. 10, 2014", 16 pgs.

(Continued)

*Primary Examiner* — Evan Dzierzynski

(74) *Attorney, Agent, or Firm* — Schwegman Lundberg & Woessner, P.A.

(57) ABSTRACT

A method of manufacturing a light emitting diode lighting assembly that includes producing a heat sink and securing a platform assembly having a plurality of light emitting diode dies on a single plane. A bulb is formed by securing a first lens section made of a first material to a second lens section made of a second material such that only the bulb determines the lamp type of the light emitting diode lighting assembly.

5 Claims, 6 Drawing Sheets

Related U.S. Application Data

(60) Provisional application No. 61/709,591, filed on Oct. 4, 2012.

(51) Int. Cl.

| | |
|---|---|
| ***F21V 29/70*** | (2015.01) |
| *F21V 3/02* | (2006.01) |
| *F21V 3/04* | (2006.01) |
| *F21V 5/04* | (2006.01) |
| *F21V 7/22* | (2006.01) |
| *F21K 9/60* | (2016.01) |
| *F21Y 101/02* | (2006.01) |
| *F21Y 115/10* | (2016.01) |

(56) References Cited

U.S. PATENT DOCUMENTS

| | | | |
|---|---|---|---|
| 5,575,459 | A | 11/1996 | Anderson |
| 5,602,709 | A | 2/1997 | Al-Dabbagh |
| 6,016,038 | A | 1/2000 | Mueller et al. |
| 6,166,496 | A | 12/2000 | Lys et al. |
| 6,357,889 | B1 | 3/2002 | Duggal et al. |
| 6,461,019 | B1 | 10/2002 | Allen |
| 6,502,954 | B1 | 1/2003 | Demkowski |
| 6,636,003 | B2 | 10/2003 | Rahm et al. |
| 6,933,707 | B2 | 8/2005 | Allen |
| 7,038,399 | B2 | 5/2006 | Lys et al. |
| 7,081,722 | B1 | 7/2006 | Huynh et al. |
| 7,102,334 | B2 | 9/2006 | Wiegand et al. |
| 7,102,344 | B1 | 9/2006 | Short |
| 7,213,942 | B2 | 5/2007 | Jiang et al. |
| 7,288,902 | B1 | 10/2007 | Melanson |
| 7,352,138 | B2 | 4/2008 | Lys et al. |
| 7,358,679 | B2 | 4/2008 | Lys et al. |
| 7,378,805 | B2 | 5/2008 | Oh et al. |
| 7,391,630 | B2 | 6/2008 | Acatrinei |
| 7,425,801 | B2 | 9/2008 | Ozaki |
| 7,489,086 | B2 | 2/2009 | Miaskin |
| 7,709,774 | B2 | 5/2010 | Schulz |
| 7,737,643 | B2 | 6/2010 | Lys |
| 7,781,979 | B2 | 8/2010 | Lys |
| 7,791,289 | B2 | 9/2010 | Oosterbaan et al. |
| 7,847,486 | B2 | 12/2010 | Ng |
| 7,859,196 | B2 | 12/2010 | Lee et al. |
| 7,863,831 | B2 | 1/2011 | Vos |
| D632,837 | S | 2/2011 | Grajcar |
| 7,880,400 | B2 | 2/2011 | Zhou et al. |
| 7,902,769 | B2 | 3/2011 | Shteynberg et al. |
| 7,936,135 | B2 | 5/2011 | Hum et al. |
| D641,520 | S | 7/2011 | Grajcar |
| 7,977,892 | B2 | 7/2011 | Lee et al. |
| 8,102,167 | B2 | 1/2012 | Irissou et al. |
| 8,120,279 | B2 | 2/2012 | Oosterbaan et al. |
| 8,134,303 | B2 | 3/2012 | Lys |
| 8,159,125 | B2 | 4/2012 | Miao |
| 8,164,276 | B2 | 4/2012 | Kuwabara |
| 8,188,679 | B2 | 5/2012 | Hoogzaad |
| 8,188,687 | B2 | 5/2012 | Lee et al. |
| 8,324,642 | B2 | 12/2012 | Grajcar |
| 8,324,840 | B2 | 12/2012 | Shteynberg et al. |
| 8,373,363 | B2 | 2/2013 | Grajcar |
| 8,384,307 | B2 | 2/2013 | Grajcar |
| 8,531,136 | B2 | 9/2013 | Grajcar |
| 8,593,044 | B2 | 11/2013 | Grajcar |
| 8,598,799 | B2 | 12/2013 | Tai et al. |
| 8,643,308 | B2 | 2/2014 | Grajcar |
| D701,497 | S | 3/2014 | Grajcar |
| 8,796,955 | B2 | 8/2014 | Grajcar |
| D719,684 | S | 12/2014 | Grajcar |
| 8,922,136 | B2 | 12/2014 | Grajcar |
| 9,255,674 | B2 | 2/2016 | Grajcar |
| 2002/0047606 | A1 | 4/2002 | Guthrie et al. |
| 2002/0097007 | A1 | 7/2002 | Koncz et al. |
| 2002/0149929 | A1 | 10/2002 | Evans et al. |
| 2003/0164809 | A1 | 9/2003 | Leung |
| 2005/0212458 | A1 | 9/2005 | Powers et al. |
| 2005/0280964 | A1 | 12/2005 | Richmond et al. |
| 2006/0098440 | A1 | 5/2006 | Allen |
| 2006/0214603 | A1 | 9/2006 | Oh et al. |
| 2007/0182338 | A1 | 8/2007 | Shteynberg et al. |
| 2007/0258240 | A1 | 11/2007 | Ducharme et al. |
| 2008/0116816 | A1 | 5/2008 | Neuman et al. |
| 2008/0203936 | A1 | 8/2008 | Mariyama et al. |
| 2008/0211421 | A1 | 9/2008 | Lee et al. |
| 2009/0160370 | A1 | 6/2009 | Tai et al. |
| 2009/0267534 | A1 | 10/2009 | Godbole et al. |
| 2010/0002451 | A1 | 1/2010 | Reynolds |
| 2010/0008086 | A1 | 1/2010 | Broitzman |
| 2010/0013402 | A1 | 1/2010 | Chaffai et al. |
| 2010/0060175 | A1 | 3/2010 | Lethellier |
| 2010/0072903 | A1 | 3/2010 | Blaut et al. |
| 2010/0164579 | A1 | 7/2010 | Acatrinei |
| 2010/0165677 | A1 | 7/2010 | Wang et al. |
| 2010/0237800 | A1 | 9/2010 | Kang et al. |
| 2010/0308739 | A1 | 12/2010 | Shteynberg et al. |
| 2010/0308751 | A1 | 12/2010 | Nerone |
| 2010/0314985 | A1 | 12/2010 | Premysler |
| 2011/0018465 | A1 | 1/2011 | Ashdown |
| 2011/0025211 | A1 | 2/2011 | Bae |
| 2011/0031890 | A1 | 2/2011 | Stack et al. |
| 2011/0037415 | A1 | 2/2011 | Juestel et al. |
| 2011/0084619 | A1 | 4/2011 | Gray |
| 2011/0101883 | A1 | 5/2011 | Grajcar |
| 2011/0176316 | A1 | 7/2011 | Phipps et al. |
| 2011/0205742 | A1 | 8/2011 | Lee |
| 2011/0273103 | A1 | 11/2011 | Hong |
| 2012/0081009 | A1 | 4/2012 | Shteynberg et al. |
| 2012/0153833 | A1 | 6/2012 | Mikani et al. |
| 2012/0161627 | A1 | 6/2012 | Chang et al. |
| 2012/0268918 | A1 | 10/2012 | Grajcar |
| 2013/0134888 | A1 | 5/2013 | Grajcar |
| 2013/0153938 | A1 | 6/2013 | Grajcar |
| 2013/0157394 | A1 | 6/2013 | Grajcar |
| 2013/0187572 | A1 | 7/2013 | Grajcar |
| 2013/0193864 | A1 | 8/2013 | Angeles |
| 2013/0342120 | A1 | 12/2013 | Creusen et al. |
| 2014/0098531 | A1 | 4/2014 | Grajcar |
| 2014/0103823 | A1 | 4/2014 | Kahman et al. |
| 2014/0111091 | A1 | 4/2014 | Grajcar et al. |
| 2014/0159584 | A1 | 6/2014 | Grajcar |
| 2014/0197741 | A1 | 7/2014 | Sakai et al. |
| 2014/0197751 | A1 | 7/2014 | Grajcar |
| 2014/0210352 | A1 | 7/2014 | Grajcar |
| 2015/0061534 | A1 | 3/2015 | Grajcar |
| 2015/0137678 | A1 | 5/2015 | Chiu et al. |
| 2015/0247612 | A1 | 9/2015 | Zhang et al. |

FOREIGN PATENT DOCUMENTS

| | | | |
|---|---|---|---|
| CN | 104106122 | A | 10/2014 |
| DE | 102010001046 | A1 | 7/2011 |
| EP | 1502483 | A1 | 2/2005 |
| EP | 2094063 | A1 | 8/2009 |
| EP | 2465174 | A1 | 2/2011 |
| EP | 2465329 | A1 | 7/2012 |
| EP | 2666220 | A2 | 7/2012 |
| EP | 2551584 | A2 | 1/2013 |
| EP | 2623846 | A1 | 8/2013 |
| EP | 2795654 | A1 | 10/2014 |
| JP | 2004248333 | A | 9/2004 |
| JP | 2006147933 | A | 6/2006 |
| JP | 2006244848 | A | 9/2006 |
| JP | 2007511903 | A | 5/2007 |
| JP | 2007299788 | A | 11/2007 |
| JP | 2008218043 | A | 9/2008 |
| JP | 2009117036 | A | 5/2009 |
| JP | 2009123427 | A | 6/2009 |
| JP | 2011040701 | A | 2/2011 |
| JP | 2014516452 | A | 7/2014 |
| JP | 5676611 | B2 | 1/2015 |
| WO | WO-0106630 | A1 | 1/2001 |
| WO | WO-2005084080 | A2 | 9/2005 |

(56) References Cited

FOREIGN PATENT DOCUMENTS

| | | | |
|---|---|---|---|
| WO | WO-2014052897 | A1 | 4/2014 |
| WO | WO-2014200960 | A1 | 12/2014 |
| WO | WO-2015002665 | A1 | 1/2015 |

OTHER PUBLICATIONS

"U.S. Appl. No. 13/676,358, Non Final Office Action filed Mar. 12, 2015", 33 pgs.
"U.S. Appl. No. 14/046,184, Non Final Office Action mailed Mar. 5, 2015", 8 pgs.
"U.S. Appl. No. 14/046,184, Notice of Allowance mailed Jun. 19, 2015", 6 pgs.
"U.S. Appl. No. 14/046,184, Notice of Allowance mailed Oct. 5, 2015", 10 pgs.
"U.S. Appl. No. 14/046,184, Response filed Jun. 4, 2015 to Non Final Office Action mailed Mar. 5, 2015", 5 pgs.
"U.S. Appl. No. 14/144,298, Non Final Office Action mailed Sep. 22, 2014", 8 pgs.
"U.S. Appl. No. 14/144,298, Notice of Allowance mailed Feb. 4, 2015", 10 pgs.
"U.S. Appl. No. 14/144,298, Notice of Allowance mailed May 22, 2015", 7 pgs.
"U.S. Appl. No. 14/144,298, Response filed Dec. 19, 2014 to Non Final Office Action mailed Sep. 22, 2014", 5 pgs.
"U.S. Appl. No. 14/160,721, Final Office Action mailed Jan. 28, 2015", 11 pgs.
"U.S. Appl. No. 14/160,721, Non Final Office Action mailed Aug. 15, 2014", 14 pgs.
"U.S. Appl. No. 14/170,760, Non Final Office Action mailed Oct. 3, 2014", 18 pgs.
"U.S. Appl. No. 14/514,612, Non Final Office Action mailed Apr. 8, 2015", 6 pgs.
"Chinese Application Serial No. 2010800467911, Office Action mailed Feb. 10, 2014", W/ English Translation, 6 pgs.
"Chinese Application Serial No. 2010800467911, Office Action mailed Sep. 3, 2014", W/ English Translation, 2 pgs.
"Chinese Application Serial No. 201080046880.6, Office Action mailed Jan. 24, 2014", W/ English Translation, 7 pgs.
"Hazard of Harmonics and Neutral Overloads", American Power Conversion Legendary Reliability: White Paper #26, (2003), 8 pgs.
"International Application Serial No. PCT/US2010/045467, International Preliminary Report on Patentability mailed Feb. 14, 2012", 7 pgs.
"International Application Serial No. PCT/US2010/045467, Written Opinion mailed Oct. 7, 2010", 6 pgs.
"International Application Serial No. PCT/US2010/054506, International Preliminary Report on Patentability mailed May 1, 2012", 7 pgs.
"International Application Serial No. PCT/US2010/054506, International Search Report mailed Feb, 28, 2010", 2 pgs.
"International Application Serial No. PCT/US2010/054506, Written Opinion mailed Dec. 28, 2010", 6 pgs.
"International Application Serial No. PCT/US2012/022059, International Preliminary Report on Patentability mailed Mar. 25, 2014", 8 pgs.
"Japanese Application Serial No. 2012-524899, Office Action filed Feb. 25, 2014", W/ English Translation, 6 pgs.
"Japanese Application Serial No. 2012-524901, Office Action filed Mar. 26, 2015", W/ English Translation, 6 pgs.
"Sequential Linear LED Driver", Supertex inc. : Doc.# DSFP-CL8800, (2014), 7 pgs
"TPS92411x Floating Switch for Offline AC Linear Direct Drive of LEDs with Low Ripple Current", Texas Instruments: SLUSBQ6B, (Oct. 2013), 29 pgs.
Taylor, Todd, "Great Green Hope: The Corporate Love Affair With Algae", Biomass Magazine, (Apr. 2010), 2 pgs.

METHOD OF MANUFACTURING A LIGHT EMITTING DIODE LIGHTING ASSEMBLY

CROSS REFERENCE

This application claims benefit of priority to and is based upon U.S. Provisional Patent Application Ser. No. 61/709,591 filed Oct. 4, 2012, titled "A Method of Manufacturing a Light Emitting Diode Lighting Assembly" by Grajcar and that application is incorporated by reference in full.

BACKGROUND OF THE INVENTION

This invention relates to a light emitting diode (LED) lighting assembly. More specifically, this invention relates to a method of manufacturing a LED lighting assembly to present different lamp types from a single manufacturing process.

Light bulbs have been around for years and come in several shapes and sizes. For example bulbs can be round, cylindrical, apple shaped, parabolic shaped, T or V shaped or the like. In particular bulbs have been shaped around a filament element presented in a vacuum. Over the years the different shaped bulbs have been given different initials and numbers associated with the different shapes of the bulb. These initials include A, B, C, CA, S, F, RP, MB, BT, R, MR, PS, AR, ALR, BR, PAR, T, G, BT, E, ED and the like. The numbers represent the amount of ⅛ths of an inch in diameter bulbs measure. So a bulb designated as 19 would be $19/8^{th}$ inches or 2⅜ inches in diameter.

As these bulbs have developed, certain bulbs have become more popular among consumers than others. For example, flood lights, such as the BR 25 and BR 30 have become popular amongst consumers. In addition the A-19 is become the standard light bulb seen in many lamps and lighting fixtures around households.

LED lighting systems have begun to be used to replace the typical incandescent light bulb. Because LED lighting systems use LEDs as their source of light instead of a filament, the need for a vacuum chamber is eliminated and power requirements are greatly reduced. Further, as a result the need of heat sinks for the circuitry of LED lighting assemblies that comprise a majority of the size of the LED lighting assemblies LED lighting assemblies do not have the same characteristics as the typical incandescent light bulb.

As a result of these differences a new manner of classifying light bulbs had to be developed. In particular, as LED lighting assemblies were being advertised and promoted companies would attempt to compare their product to known incandescent light bulbs in the field. This lead to many false claims and comparisons confusing consumers. As a result the Environmental Protection Agency (EPA) has developed standards and labeling requirements to protect the consumer and allow all manufacturers and sellers of different lights to know how different lights are classified. These standards are known as Energy Star® requirements as indicated in the document entitled Energy Star® Program Requirements for Integral LED Lamps Eligibility Criteria—Version 1.4.

As an example, for omnidirectional lamp types (lamp types A, BT, P, PS, S, T (per ANSI C79.1-2002)) multiple criteria have been determined including minimum Luminous Efficacy, LED lamp power<10 W, LED lamp power>10 W, Minimum Light Output, Luminous Intensity Distribution, Maximum lamp diameter, Maximum overall length, Lumen Maintenance and Rapid-Cycle Stress Test. To illustrate, for omnidirectional lamp types for the Minimum Light Output the "Lamp shall have minimum light output (initial total luminous flux) at least corresponding to the target wattage of the lamp to be replaced" where target wattages between the given levels may be interpolated. Thus, for an LED lamp to be considered an equivalent of 40 watt incandescent light bulb the minimum initial light output of the LED lamp must be 450 lumens, for an equivalent 60 watt incandescent light bulb a minimum of 800 lumens must be shown and for an equivalent to a 75 watt incandescent light bulb 1,100 lumens must be shown.

As another example, for the omnidirectional lamp types for Luminous Intensity Distribution "Products shall have an even distribution of luminous intensity (candelas) within the 0° to 135° zone (vertically axially symmetrical). Luminous intensity at any angle within this zone shall not differ from the mean luminous intensity for the entire 0° to 135° zone by more than 20%. At least 5% of total flux (lumens) must be emitted in the 135%-180% zone. Distribution shall be vertically symmetrical as measured in three vertical planes at 0°, 45°, and 90°".

Similarly decorative lamp types (lamp types B, BA, C, CA, DC, F, G (per ANSI C79.1-2002)) and directional lamp types (lamp types BR, ER, K, MR, PAR, R (per ANSI C79.1-2002)) have their own criteria. In this manner if LED manufactures manufacture an LED lighting assembly meeting the criteria for an omnidirectional lamp type and that has a diameter that is 2⅜ inches in diameter the manufacturer may then label an advertise the LED lighting assembly as an equivalent A-19 lamp type. Alternatively if an LED lighting assembly is manufactured meeting the criteria for a directional lamp that is 25/8 (3⅛ inches) in diameter the assembly can be considered an equivalent BR 25 lamp type.

Currently in the manufacturing process for LED lighting assemblies to meet the different criteria, different manufacturing processes must be undertaken to produce different products. For example a different manufacturing process is undertaken if manufacturing an A-19 lamp type as compared to a BR-25 or BR-30 lamp type. In this manner if an order for additional BR lamp type comes to a manufacturer, the manufacturer cannot easily produce more lamps without starting an entire new line for the lamp type. This results in additional costs and is time consuming.

Thus a need in the art exists to present a LED lighting assembly and manufacturing process that presents a simple process for manufacturing LED lighting assemblies meeting criteria of any lamp type. Further there is a need to provide an efficient manufacturing process in order to mass produce different lamp types using a single LED lighting module.

Therefore, a principle object of the present invention is to provide an improved method of manufacturing a LED lighting assembly that provides ease in manufacturing;

Yet another object of the present invention is to provide an efficient manufacturing process for making LED lighting assemblies;

These and other objects, features and advantages will become apparent from the rest of the specification and claims.

SUMMARY OF THE INVENTION

A method of manufacturing a light emitting diode lighting assembly including providing a heat sink that is connected to a light emitting diode light source. A lens is formed by securing a first lens section to a second lens section. The lamp type of the lighting assembly is determined by the selection of the first and second lens sections. In this manner a lighting assembly can be manufactured to meet the criteria of A-19 lamp type, BR-25 lamp type, BR-30 lamp type or other lamp type based solely on the selection of interchangeable lens sections.

DETAILED DESCRIPTION OF A PREFERRED EMBODIMENT OF THE INVENTION

Figure 1:
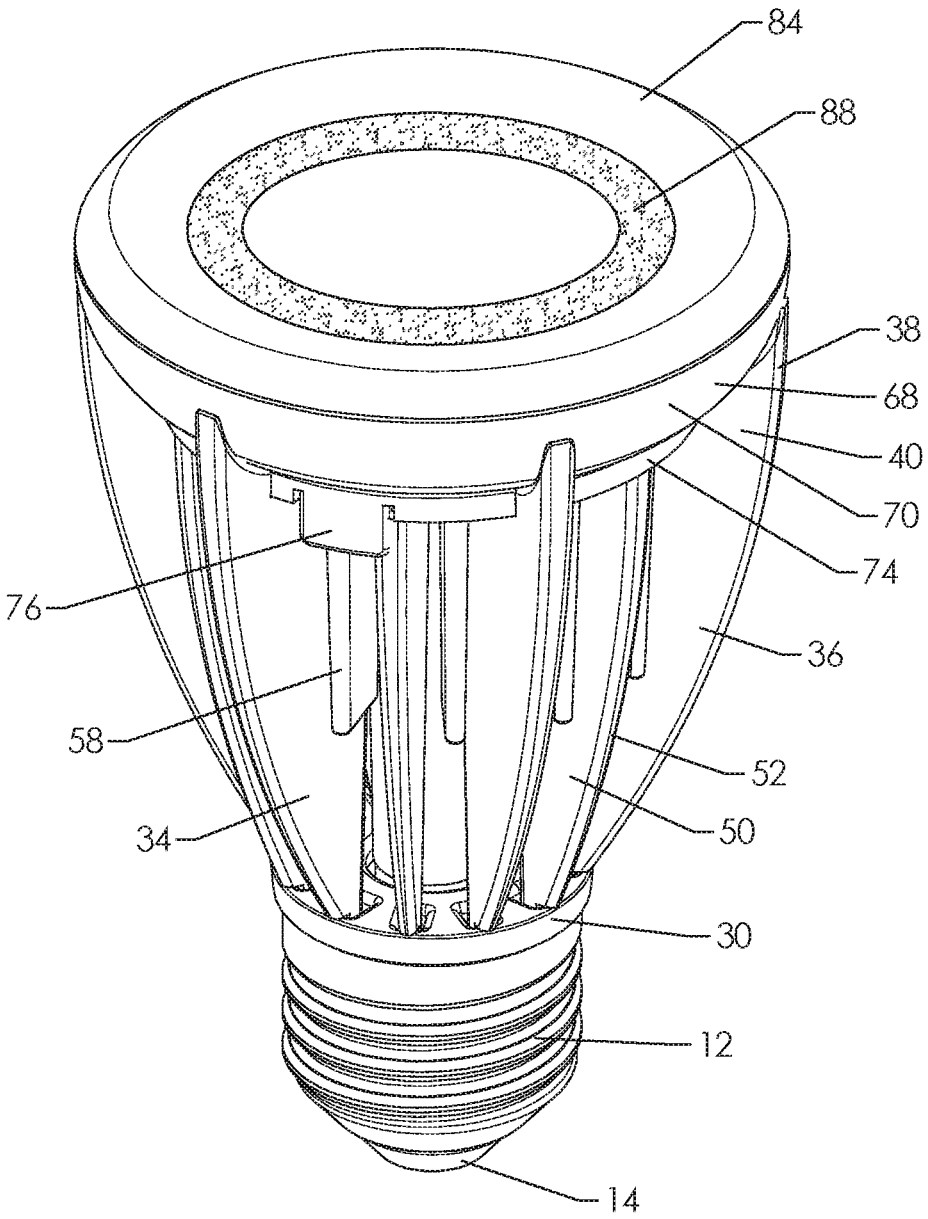
FIG. 1 is a perspective view of an LED lighting assembly without a bulb.
Figure 2:
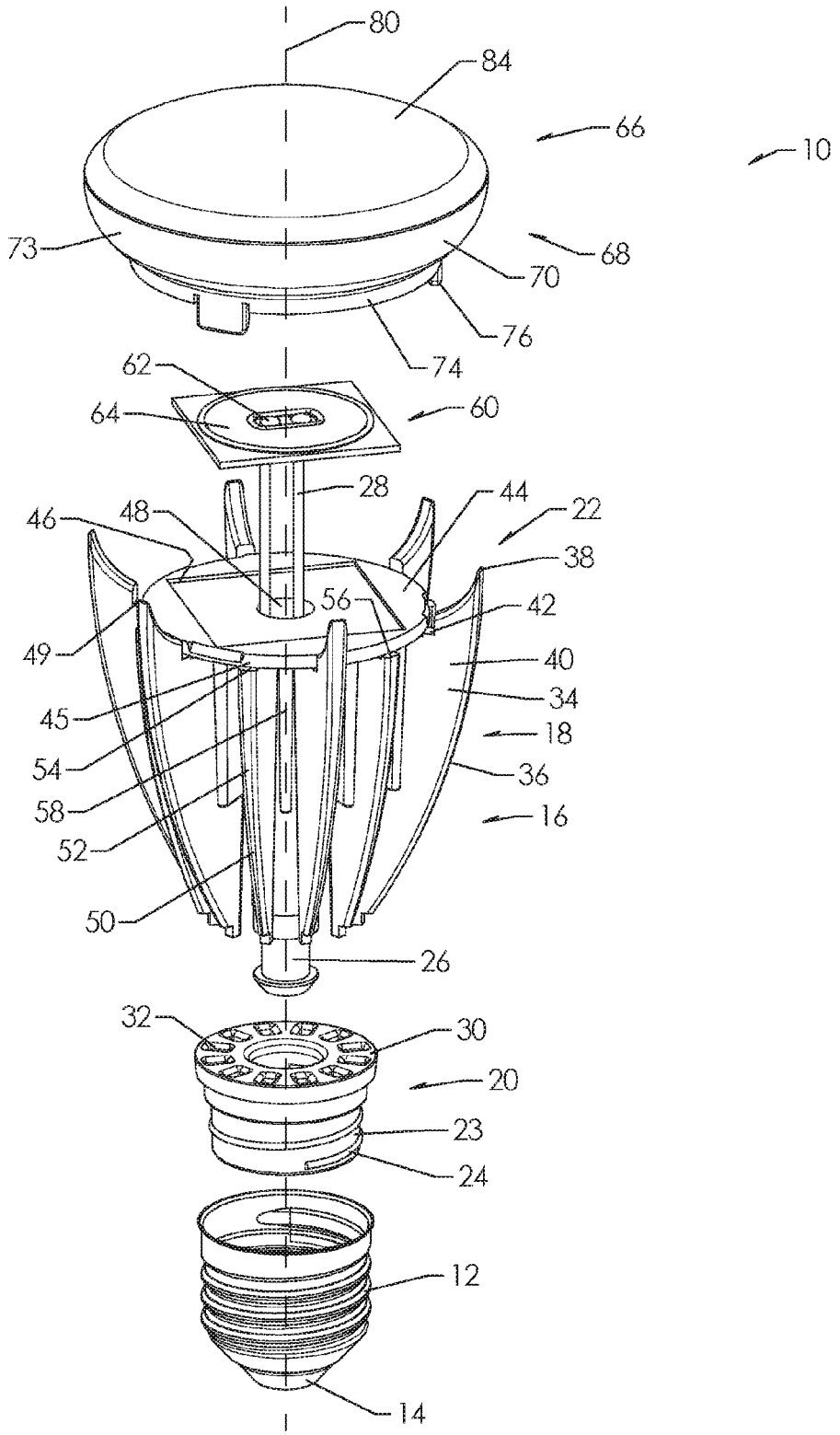
FIG. 2 is an exploded perspective view of an LED lighting assembly with a bulb.
Figure 3:
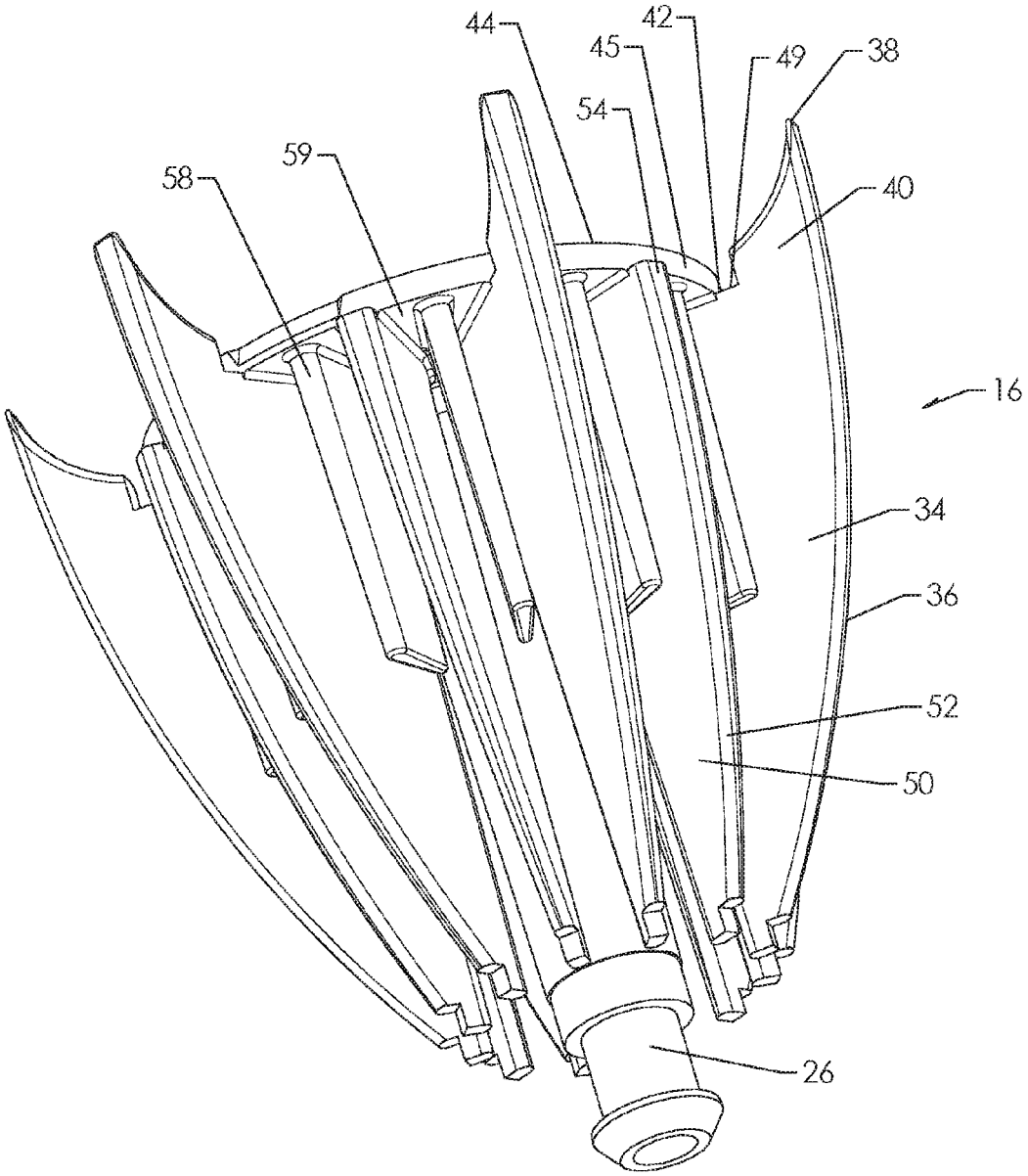
FIG. 3 is a side perspective view of a heat sink of an LED lighting assembly.
Figure 4:
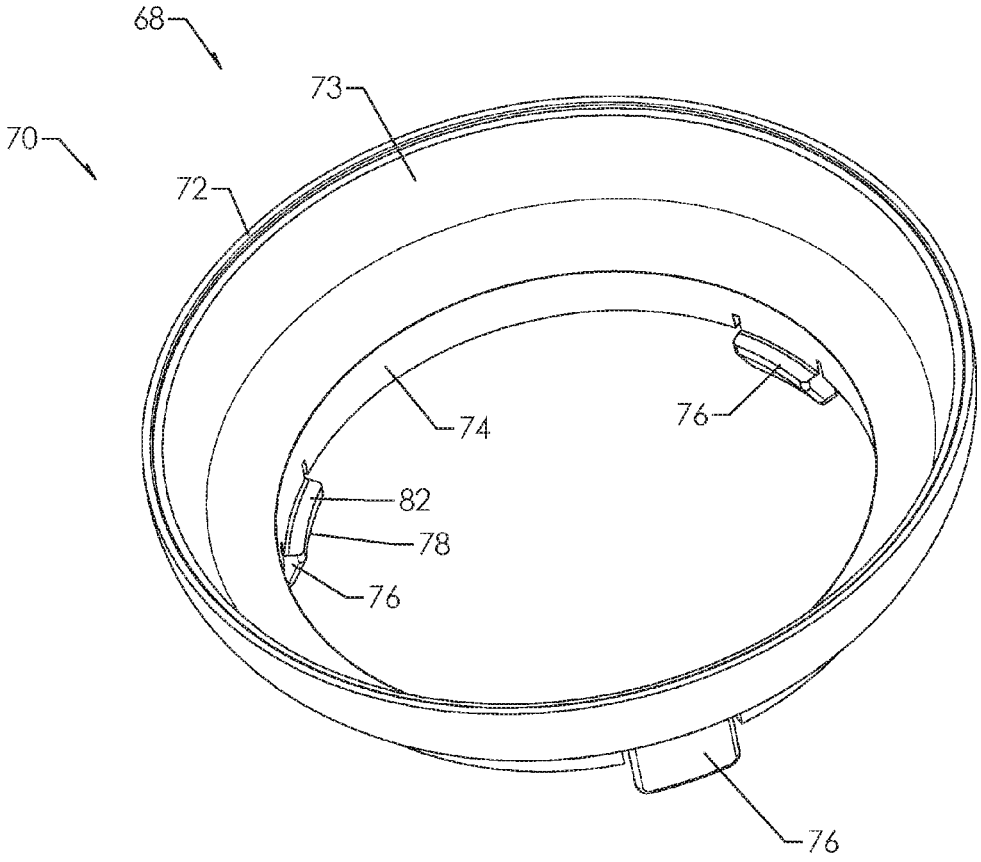
FIG. 4 is a top perspective view of a first lens section of a bulb for an LED lighting assembly.
Figure 5:
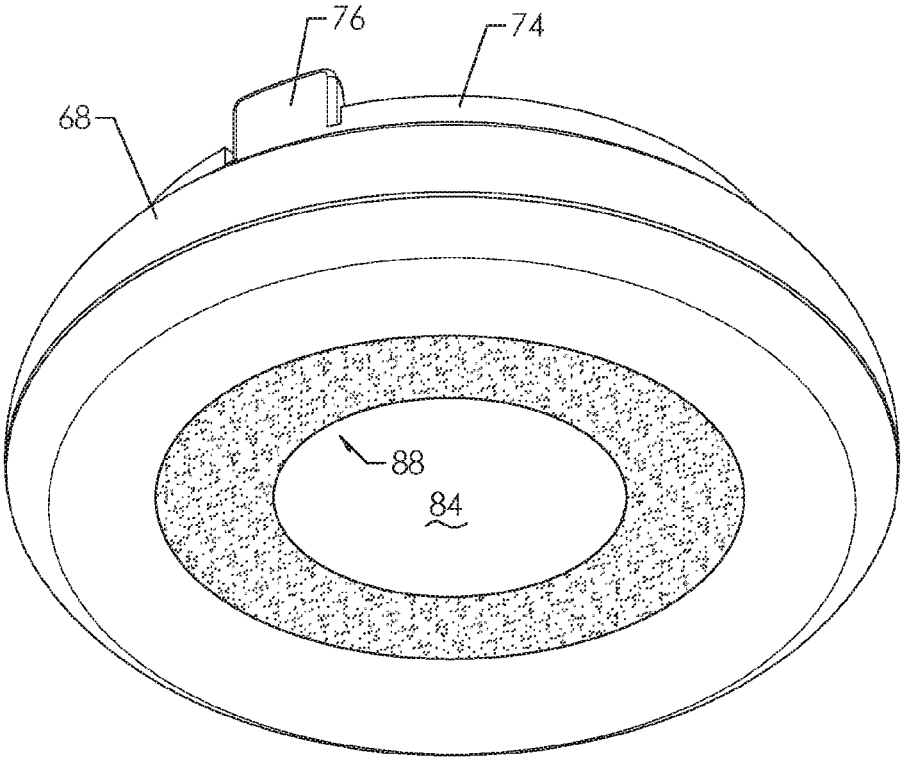
FIG. 5 is a top perspective view of a bulb of an LED lighting assembly.
Figure 6:
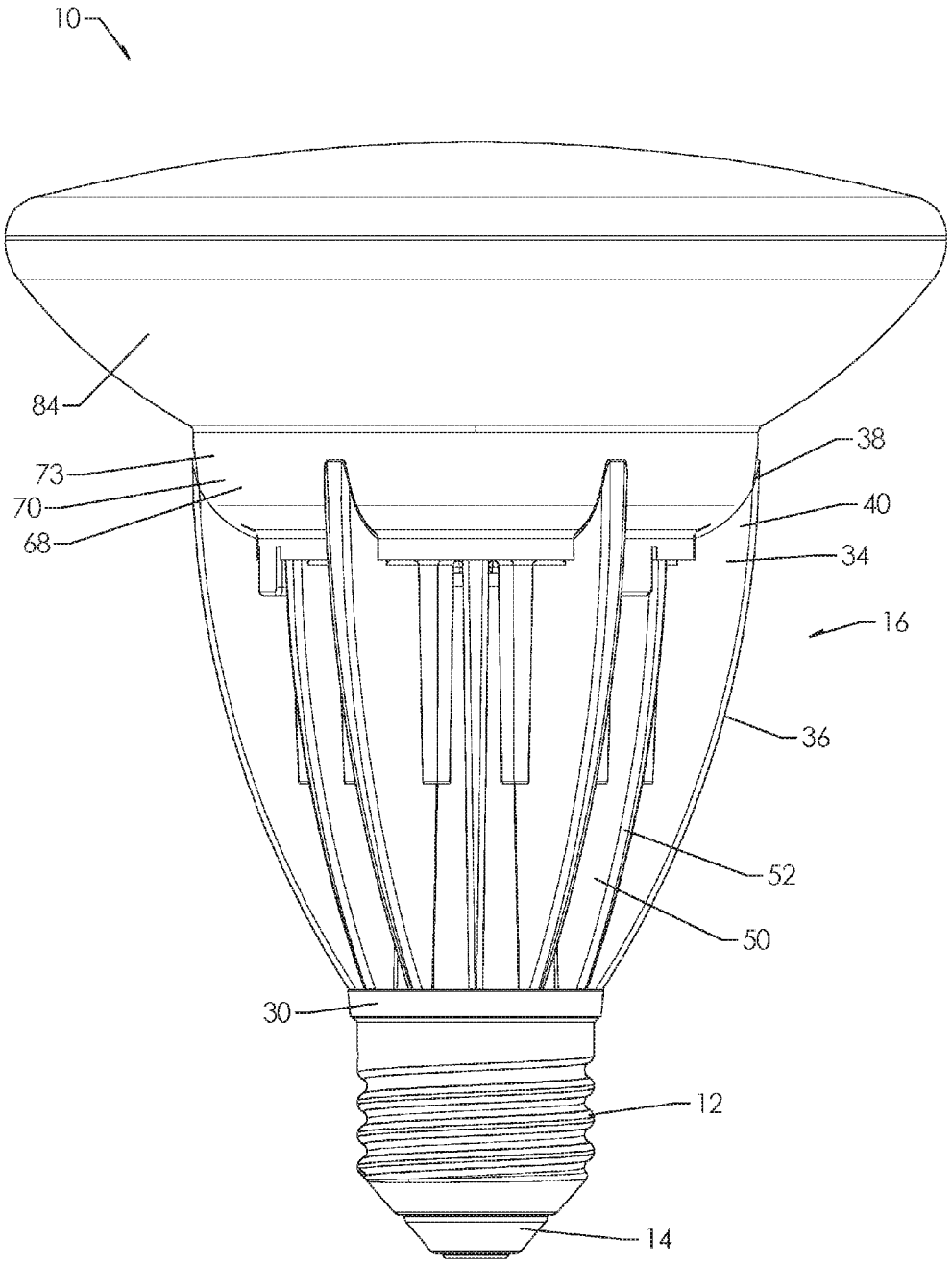
FIG. 6 is a side plan view of an LED lighting assembly with a bulb.

The figures show a light emitting diode (LED) lighting assembly 10. The LED lighting assembly 10 includes a base 12 that has electrical conducting elements 14 such that the base 12 can be inserted into a traditional lighting socket to receive an AC power input. The base 12 is threadably secured to a heat sink 16.

The heat sink 16 has a body 18 that extends from a first end 20 to a second end 22. At the first end 20 is a connecting body 23 that can be of one piece construction and part of the heat 16 or optionally a separate body secured to the heat sink 16. The connecting body has threads 24 that threadably receive the base 12. A centrally located conduit 26 extends from adjacent the first end 20 of the body 18 to the second end 22 of the body 18. The conduit 26 receives a conductive element 28 or wiring that extends through the body 18 and provides an electrical communication path from a socket via the base 12 through the heat sink 16.

A heat sink base 30 is part of the connecting body 23 and is located adjacent the threads 24 at the first end 20 of the heat sink 16. In one embodiment the heat sink base 30 is a round surface having a plurality of openings 32 for receiving a plurality of primary fin members 34 that extend radially from adjacent the conduit 26. The plurality of primary fin members 34 are attached and secured within the openings 32 and extend upwardly away from the heat sink base 30 and radially away from the conduit 26 to form an arcuate outer surface 36 that extends to a point 38 of a pointed section 40 where the pointed section 40 extends from a flange 42 that is secured to the underside of a platform base 44. The platform base 44 in one embodiment is round with a single outer edge 45 and has a square shaped indention 46 disposed therein surrounding an opening 48 that aligns with the terminating end of the conduit 26 to provide a path for the conductive element 28. The outer edge 45 is spaced apart from the pointed section 40 to form a notch 49 on the flange 42 between the outer edge 45 and pointed section 40.

A plurality of support members 50 similar to the primary fin members 34 are attached and secured within the openings 32 and extend away from the heat sink base 30 and radially away from the conduit to form an arcuate outer surface 52 that terminates at an end 54 that engages and extends along the bottom surface of the platform base 44. In one embodiment the end 54 is secured to the platform base 44 such that a lip 56 extends past the platform base. Each support member 50 is positioned between consecutive primary fin members 34 where in one embodiment the support member 50 is equidistance from the primary fin members 34.

A plurality of secondary fin members 58 are secured to the bottom surface of the platform base 44 and extend downwardly away from the platform base 44.

While most of the secondary fin members 58 are secured to the bottom of the platform base 44 adjacent the edge 45 of the platform base 44, a few selected secondary fin members 58 are offset from the edge 45 to form an engagement surface 59 on the bottom of the platform base 44. The secondary fin members 58 are also located between primary fin members 34 and support members 58. Each of the primary fin members 34, support members 50 and secondary fin members 58 have ridges that convey or transfer heat away from a platform assembly 60 mounted on the platform base 44.

The platform assembly 60 is mounted in the indentation 46 of the platform base 44 and includes electronic components 62 including light emitting diode dies 64 for producing light. Heat generated by the electronic components 62 is conveyed from the platform assembly 60 to the platform base 44 of the heat sink 16. The platform assembly 60 is also electrically connected to the conductive element 28 or wiring disposed through the conduit 26 of the heat sink 16.

FIGS. 4-7 show various bulbs 66 that may be attached to the heat sink 16 in order to form LED lighting assemblies 10. Each bulb 66 has a first lens section 68 that has a generally frustroconically shaped first lens body 70 that has a circular top surface 72 and a continuous arcuate sidewall 73 extends downwardly and inwardly from the top surface 72 to an annular flange 74 that extends downwardly perpendicular to the top surface 72.

In one embodiment disposed in and extending past the annular flange 74 is at least one tab member 76 that is generally V-shaped and form an inclined plane element 78 that extends radially toward a central axis 80 of the first lens section 68 and terminates at a tab member flange 82. In another embodiment the first lens section has three tab members 76.

The tab member 76 is thus shaped such that when the first lens section 68 is placed with the tab member 76 facing downward toward the platform base 44 onto the platform base 44 with no downward force being applied the tab member 76 rests on the platform base 44 and engages the edge 45 of the platform base 44. Once downward pressure is applied to the first lens section 68 the edge 45 of the platform base biases the tab member 76 away from the center axis 80 as the inclined plane element 78 slides along the edge 45 of the platform assembly base 44. Once the edge 45 clears the tab member flange 82 the tab member 76 snaps or is biased back toward the center axis 80 to frictionally secure the first lens section 68 to the heat sink 16. When secured the annular flange 74 of the first lens section 68 is disposed within the notch 49 adjacent the edge 45 to encapsulate the platform assembly 60.

A second lens section 84 is secured to the first lens section 68 prior to securing the first lens section 68 to the heat sink 16 such that the entire bulb is secured to the heat sink 16 in one operation. The second lens section 84 can be any size or shape as long as the bottom surface 86 of the second lens section 84 is the same shape and size to matingly engage the top surface 68 of the first lens section 68. Along this interface the first and second lens sections 68 and 84 are secured to one another.

As a result of having a platform assembly 60 and thus LED dies 64 on a single plane on the heat sink 16 the range of lumen output is controlled by selection of materials and altering characteristics of the first and second lens sections 68 and 84 to meet different criteria to determine the lamp type of the assembly 10. In this manner identical heat sinks 16 and platform assemblies 60 can be manufactured and secured to one another regardless of the lamp type and the selection of interchangeable lens sections 64 and 84 determine the lamp type.

For example, in a first embodiment as shown in FIG. 1 the second or top lens section 84 is made of a material that has both a high diffusion rate and high reflection coefficient. Specifically, the reflection coefficient through glass 4%, thus a reflection coefficient above 4% is considered a high reflection coefficient and a reflection coefficient below 4% is considered a low reflection coefficient. A high diffusion rate is considered any material that diffuses light more than ten degrees as compared to when the material is not used and a low diffusion rate is any material that diffuses light less than ten degrees as compared to when the material is not used.

In one embodiment this material is a white polycarbonate resin such as LUX9612™ resin made by Sabic Innovative Plastics Asia Pacific™. Meanwhile in this embodiment the bottom or first lens section 68 is made of a material having a low diffusion rate and a low coefficient of reflection. In one embodiment the material is a white polycarbonate resin such as LUX9616™ resin made by Sabic Innovative Plastics Asia Pacific™.

In this embodiment by having a top lens section 84 that has a high diffusion rate, light going through the top lens section 84 spreads out or diffuses such that an even distribution of luminous intensity within the 0° to 135° zone is achieved to meet the Luminous Intensity Distribution criteria to be considered an omnidirectional lamp. Similarly, because the top lens section 84 also has a high coefficient of reflection light is reflected toward the bottom lens section 68. Because the bottom lens section 68 has a low coefficient of reflection and low diffusion rate, the reflected light from the top lens section 84 passes through the bottom lens section 68 to maximize the total flux emitted in the 135° to 180° zone again to meet the 5% of total flux emitted in the 135° to 180° zone Luminous Intensity Distribution criteria so the assembly is considered a omnidirectional lamp. At this point only the diameter of the system needs to be varied to present the exact lamp type such as an A-19 lamp.

In a variation of this embodiment a portion of reflective material 88 is formed on the top lens section 84. In one embodiment this portion of reflective material is a metallic ring formed on the interior surface of the top lens section 84 to reflect light toward the bottom lens section 68. In another embodiment the portion of reflective material 88 is a plurality of spaced apart metallic particles formed on the interior surface again to reflect light toward the bottom lens section 68. In either embodiment, the portion of reflective material 88 functions to reflect light toward the bottom lens section 68 causing a greater amount of total flux emitted in the 135° to 180° zone in order to meet the Luminous Intensity Distribution criteria for an omnidirectional lamp type. In this manner the portion of reflective material 88 provides a boost to the omnidirectional lamp type.

In yet another embodiment the lamp type desired to be manufactured is a directional lamp such as a BR lamp type. In this embodiment the top lens section 84 selected has a low diffusion rate and low coefficient of reflection and a bottom lens section 68 having a reflective material on an interior surface. In this manner light emitted through the top lens section 84 is directed toward to a solid angle of $\pi$ sr (corresponding to a cone with angle of 120°) and any light directed toward the bottom lens section 68 is reflect toward the first lens section 84 to again keep light in the 120° angle. In this manner the assembly 10 meets the Energy Star® criteria definition of a directional lamp, that being a lamp having at least 80% light output within a solid angle of $\tau$ sr (corresponding to a cone with angle of 120°). Thus, as long as the other criteria are met the assembly in this embodiment can be considered a BR lamp type. Further, by selecting a top lens section 84 with a predetermined diameter, such as 20/8 inches (2½ inches) or 30/8 inches (3¾ inches) a BR 20 or BR 30 lamp type is formed.

In operation when manufacturing the LED lighting assembly 10 a heat sink 16 is manufactured by any known manufacturing method. A platform assembly 60 is secured to the platform base 44 to provide a plurality of LED dies 64 on a single plane. A bulb 66 is then formed by selecting a first lens section 68 with predetermined structure and materials and selecting a second lens section 84 based on the structure, materials and characteristics of the first lens section and securing the first and second lens sections 68 and 84 together. The bulb 66 is then frictionally secured to the heat sink 16. Based solely on the selection of first and second lens sections 68 and 84 the lamp type is determined.

Thus presented is an LED lighting assembly 10 and method of manufacturing the same. By presenting sections 68 and 84 can be formed so that the lamp type is determined based solely on the selection of the lens sections 68 and 84. In this manner during the manufacturing process the manufacturing of all components, including the heat sink 16 and LED dies 64 on a single plane a plurality of lens platform assembly 60 are identical for all lighting assemblies regardless of lamp type. Instead when a new lamp type is required, instead of forming an entire new line to form an assembly 10 one need only switch out the type of lens sections 68 and 84 and often only the material of the lens sections 68 and 84 to create a new lamp type. Therefore, manufacturing is more efficient and cost efficient and at the very least all of the stated objects have been met.

What is claimed is:

1. A method of manufacturing a light emitting diode lighting assembly steps comprising:

producing a heat sink connected to a light emitting diode light source;

selecting a first lens section having a first diffusion rate and first reflection coefficient;

selecting a second lens section having a second diffusion rate and second reflection coefficient;

securing the first and second lens section together to form a bulb;

securing the first lens section to the heat sink; and wherein only the selection of the first lens section and second lens section determines the lamp type of the light emitting diode lighting assembly;

wherein the lamp type is an omnidirectional lamp.

2. The method of claim 1 wherein the bulb is frictionally secured to the heat sink.

3. The method of claim 1 wherein the first lens section has a portion of reflective material thereon.

4. The method of claim 3 wherein the portion of reflective material is a metallic ring formed on the second lens section.

5. The method of claim 3 wherein the portion of reflective material is a plurality of spaced apart reflective particles.

* * * * *